US008739487B2

(12) United States Patent
Gerkes et al.

(10) Patent No.: US 8,739,487 B2
(45) Date of Patent: Jun. 3, 2014

(54) SUSPENDED CEILING SYSTEM FOR "T" BAR GRID SYSTEM

(75) Inventors: Martin Daniel Gerkes, Toronto (CA); Heikki Kolga, Maple (CA); Ronald White, Holland Landing (CA)

(73) Assignee: CertainTeed Canada, Inc., Toronto, ON (CA)

( * ) Notice: Subject to any disclaimer, the term of this patent is extended or adjusted under 35 U.S.C. 154(b) by 318 days.

(21) Appl. No.: 13/067,495

(22) Filed: Jun. 6, 2011

(65) Prior Publication Data

US 2011/0308185 A1 Dec. 22, 2011

(30) Foreign Application Priority Data

Jun. 4, 2010 (CA) ..... 2706034

(51) Int. Cl.
*E04B 2/00* (2006.01)

(52) U.S. Cl.
USPC ..... 52/506.07; 52/39; 52/220.6

(58) Field of Classification Search
USPC ..... 52/506.06, 506.07, 506.08, 220.6, 39
See application file for complete search history.

(56) References Cited

U.S. PATENT DOCUMENTS

| | | | | | |
|---|---|---|---|---|---|
| 3,021,915 | A * | 2/1962 | Kemp | 181/290 |
| 3,973,368 | A * | 8/1976 | Moeller | 52/476 |
| 4,089,146 | A * | 5/1978 | Martinez | 52/506.08 |
| 5,081,812 | A * | 1/1992 | Reynolds | 52/506.06 |
| 5,311,719 | A * | 5/1994 | Jahn | 52/506.09 |
| 5,428,930 | A * | 7/1995 | Bagley et al. | 52/506.07 |
| 5,535,566 | A * | 7/1996 | Wilson et al. | 52/506.07 |
| 7,658,046 | B2 * | 2/2010 | Lynch et al. | 52/506.07 |
| 7,661,236 | B2 * | 2/2010 | Platt et al. | 52/506.06 |
| 7,908,813 | B2 * | 3/2011 | Gulbrandsen et al. | 52/506.09 |
| 2001/0032433 | A1 * | 10/2001 | Harris | 52/506.06 |
| 2009/0173030 | A1 * | 7/2009 | Gulbrandsen et al. | 52/506.09 |
| 2011/0252736 | A1 * | 10/2011 | Bailey et al. | 52/506.07 |

* cited by examiner

*Primary Examiner* — Branon Painter

(57) ABSTRACT

A ceiling panel uses a perimeter frame with a wide outwardly extending bottom flange defining a thin panel edge. Preferably the bottom flange includes a lower surface for securing of a finished substrate about the panel perimeter. The upper surface of the bottom flange receives a gusset clip that includes two arms for securement of the bottom flange and an upwardly extending lift and shift securing tab. The upwardly extending lift and shift securing tab is preferably located within a depth of the ceiling panel generally defined by an acoustical dampening material located within the perimeter frame.

18 Claims, 11 Drawing Sheets

SUSPENDED CEILING SYSTEM FOR "T" BAR GRID SYSTEM

FIELD OF THE INVENTION

The present invention relates to suspended ceiling systems, and in particular, to a ceiling panel having an enlarged perimeter flange for securement beneath a "T" bar grid system, and a particular structure of the ceiling panel.

BACKGROUND OF THE INVENTION

"T" bar ceiling systems are extremely well known and are primarily used for receiving a fiber type ceiling panel that is supported above outwardly extending flanges of the "T" bar grid system. With this arrangement, the bottom flange of the "T" bar grid components is visible from below and forms part of the finished ceiling surface. In most cases the ceiling panels are generally planar and located above the bottom flange. In some "T" bar ceiling systems the acoustical panels may be contoured and partially extend below the "T" bar grid system while still supported at the perimeter edge by the "T" bar grid members. This type of arrangement reduces the visual effect of the exposed "T" bars but the lower flanges continue to be visible.

It is also known to use a "T" bar grid system for suspending ceiling panels below the grid system such that the ceiling panels hide the "T" bar grid network (concealed "T" bar ceiling system). In these systems the upper edge of the ceiling panels engage the lower flange of the "T" bar grid network. Torsion springs or other securing arrangements suspend the ceiling panels beneath the "T" bar grid system.

A lift and shift "T" bar grid ceiling panel system is known that suspends ceiling panels beneath a "T" bar grid network. In some lift and shift grid ceiling panel systems a portion of the grid network is exposed and forms part of the finished ceiling system. Other lift and shift ceiling panel systems are designed to overlap substantially on the lower surface with the "T" bar members thus hiding the grid network. In this type of system the acoustical panel is oversized relative to the cells of the grid network. The ceiling panels are secured to the grid network by initially suspending one edge of a panel and shifting it over relative to the grid network. The panel may then be moved to the horizontal position and shifted in the opposite direction to suspend the opposite edge of the ceiling panel.

Although these systems in theory provide an accurate ceiling (little variation in the plane of the ceiling), the known lift and shift systems locate the ceiling panels below the grid network and the suspension clips of each panel are mounted on a top surface of the panel. To avoid or reduce possible damage the suspension clips are secured to the panels on site by the installer. This is a time consuming process and introduces a further variable that may affect the quality of the ceiling system.

The present invention seeks to overcome a number of manufacturing issues with respect to lift and shift suspended ceiling systems, and also provides a system which is convenient to install.

SUMMARY OF THE INVENTION

A ceiling panel according to the present invention comprises a perimeter frame, an acoustical insert secured within the perimeter frame, and positioned to be inwardly offset to a side edge of the ceiling panel. A finished surface substrate is secured beneath and covers a lower surface of the perimeter frame and the acoustical insert material. The perimeter frame comprises a series of connected extruded members where each extruded member includes an outwardly extending flange defining a wide border edge of the ceiling panel and an integral vertical section to one side of the flange. The outwardly extending flange and the integral vertical section collectively form a stepped side edge of the ceiling panel. The finished surface substrate is secured to the outwardly extending flange of each extruded member and the vertical section of each extruded member is held in abutting contact with a side edge of the acoustical insert.

In a preferred aspect of the invention, each extruded member includes in cross section at least one securing flange extending inwardly from the vertical section and located at an end of the vertical section opposite the outwardly extending flange or at an intermediate position on the vertical section.

In yet a further aspect of the invention each extruded member includes two inwardly extending securing flanges positioned in a non-aligned manner with the outwardly extending flange.

In yet a further aspect of the invention one of the inwardly extending flanges overlies a top edge of the acoustical insert.

In a different aspect of the invention one of the inwardly extending flanges is received and projects into a side edge of the acoustical insert.

In a preferred aspect of the invention a top surface of each outwardly extending flange includes a low profile securing channel extending in a length of the extruded member. Preferably gusset securing brackets are provided where each gusset securing bracket is received in the low profile securing channels of abutting extruded members with these gusset securing brackets connecting abutting extruded members.

In a further aspect of the invention, each gusset securing bracket is generally an L-shaped stamped plate with at least one upwardly and forwardly extending securing tab defining a securing gap below said securing tab for supporting said ceiling panel from a "T" bar grid.

In yet a further aspect of the invention each gusset securing bracket includes a first flat arm without any significant protrusions on an upper surface thereof and a second flat arm having at least one upwardly extending securing tab with a horizontal extending segment.

In yet a further aspect of the invention the outwardly extending flange of each extruded member includes on a bottom surface thereof a series of longitudinally extending shallow ribs of progressively decreasing height from the vertical section to the perimeter of the ceiling panel. Preferably these series of shallow ribs include at least three shallow ribs.

In yet a further aspect of the invention the ceiling panels are preferably rectangular in shape with gusset securing brackets provided in each corner of the rectangular shaped ceiling panel.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
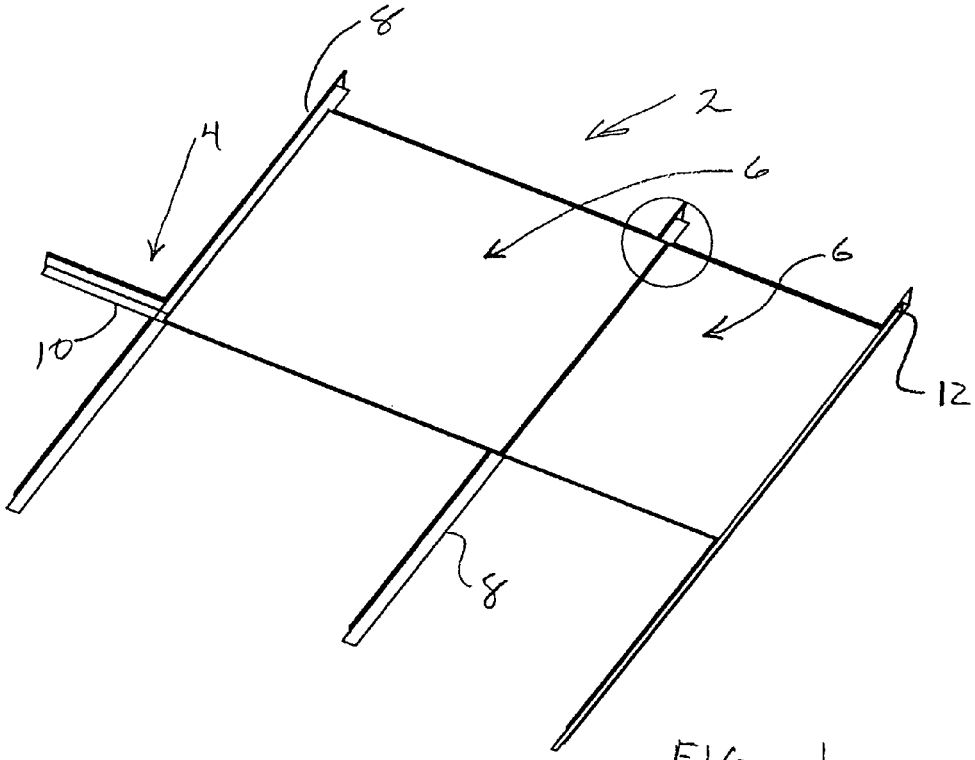
FIG. 1 is a partial perspective view showing the suspended ceiling grid system.

The suspended ceiling system 2 includes the "T" bar support grid 4 with a series of suspended ceiling panels 6 secured to the underside of the support grid. The support grid includes main T-members 8 and cross T-members 10. Also shown in FIG. 1 is an "T"-member 12 which is L-shaped to support a ceiling panel adjacent a vertical wall. As shown from the perspective view of FIG. 1 looking upwardly, the ceiling panels 6 essentially hide the "T" bar support grid such that the "T" bar support grid is not visible from below the ceiling panel. As more clearly shown in the perspective view of FIG. 2, the ceiling panels 6 hide the bottom flange of the main "T"-member 8.

The "T" bar support grid generally shown as 4 is extensively used in ceiling systems, is relatively inexpensive and is well known to a host of installers. During installation, the main "T"-members 8 are appropriately suspended beneath an unfinished ceiling. Once the main "T"-members 8 have been located, cross "T"-members 10 are mechanically connected to the main "T"-members 8. There are a number of different "T" bar grid systems, but these systems all work in a similar manner. Although care is taken to accurately position the grid network, some variation occurs, particularly with respect to the position of the cross "T"-members 10.

Figure 7:
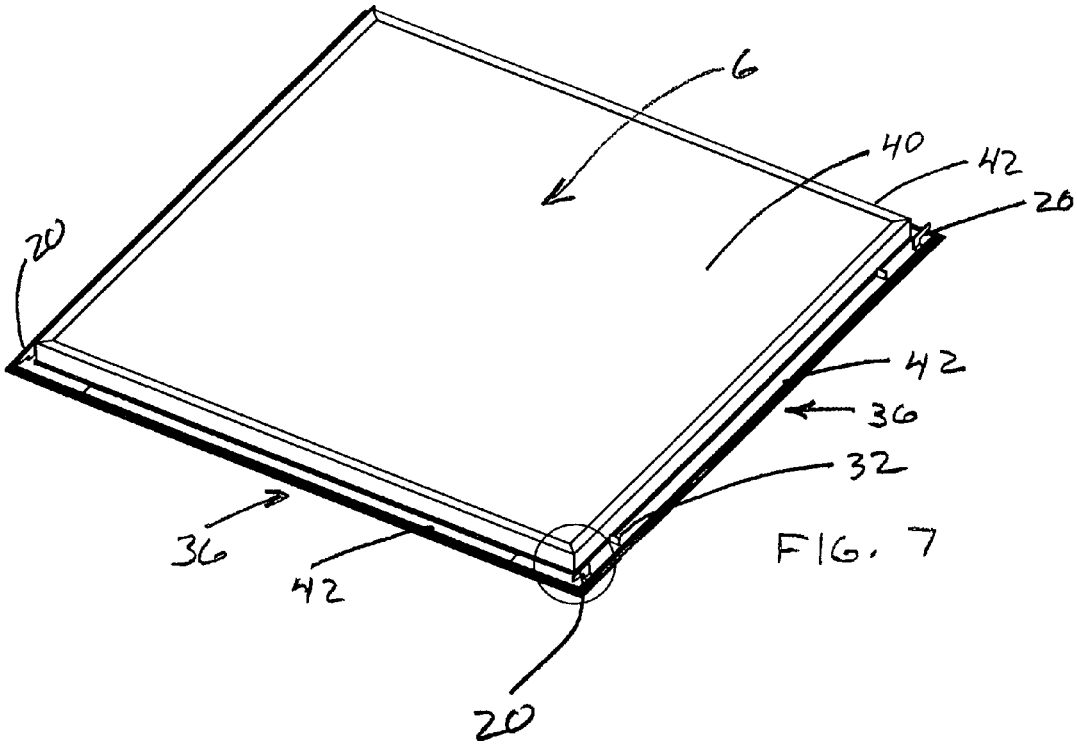
FIG. 7 is a partial perspective view showing the top surface of a ceiling panel.
Figure 8:
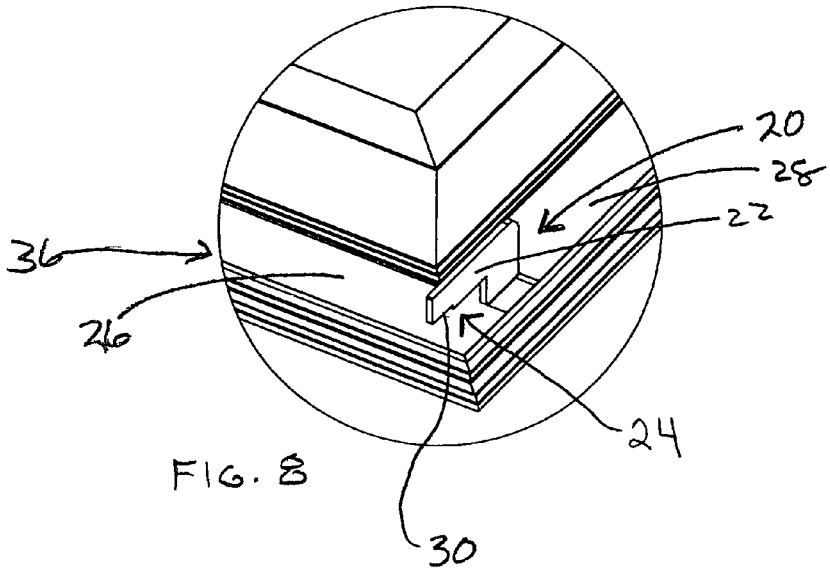
FIG. 8 is a partial perspective view of one of the corners of the ceiling panel shown in FIG. 7.

The ceiling panels shown in the figures are referred to as lift and shift ceiling panels. In this case, the particular securing mechanism allows the panels to be shifted in one direction typically towards a main "T"-member 8 and subsequently the panel is pivoted upwardly to the horizontal position and shifted in the opposite direction to engage a further "T"-member. Although the preferred arrangement is to support the panel on the main "T"-members 8, it can be appreciated that support the panel on the cross "T"-members 10 is also possible. There is a slight gap between adjacent panels that is preferably kept to a minimum to hide the "T" bar grid network In contrast to existing lift and shift suspended ceiling systems, the present ceiling panels include a wide outwardly extending flange defining a wide border area about the ceiling panel. This aspect can be appreciated from a review of FIG. 4, the perspective view of the ceiling panel shown in FIG. 7, and the additional details shown in the partial view of FIG. 8 showing a corner of the panel. This allows the flanges of the panels to be immediately below the "T" bar grid with a portion of the body of the panel above the bottom flange of the grid. The wide flange provides the required space for the lift and shift installation. Preferably, the wide flange is at least 1 cm wide and a flange with a width between 1.5 cm and 2.0 cm is practical for many applications.

Figure 9:
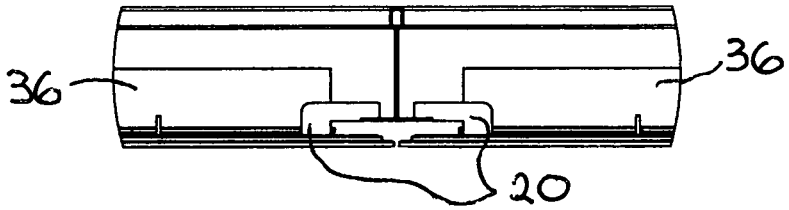
FIG. 9 is a side view showing two ceiling panels secured to a main grid member.
Figure 11:
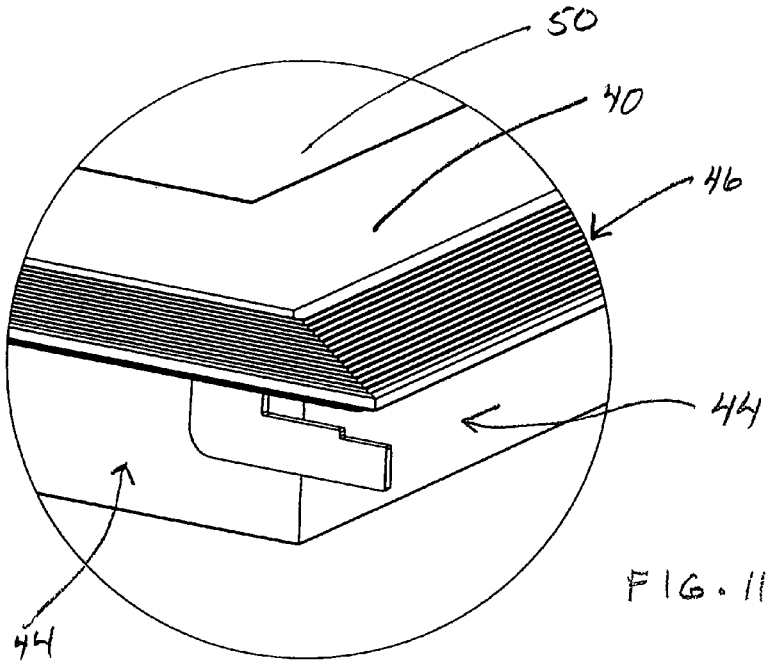
FIG. 11 is an exploded perspective view showing the components of the ceiling panel.

Each ceiling panel includes an outwardly extending perimeter flange 36 which is of a thin profile with the body of the ceiling panel including the acoustical dampening material 40 located interior to this flange. Preferably, this perimeter flange is defined by an extrusion member 60 and the upper surface of the perimeter flange 36 includes a securing channel 64 for receiving gusset clips 20. In this way the gusset clips 20 are associated with the lower surface of the ceiling panel and is only separated from this lower surface by the thickness of the perimeter flange. A large portion of the ceiling panel including the acoustical dampening material is located above the bottom flange of the "T" bar grid support network as shown in the view of FIG. 9 and the perspective views of FIGS. 4 and 11.

The large perimeter flange about the ceiling panel with the inwardly offset acoustical dampening material allows for the lift and shift installation of panels in combination with the perimeter flange, gusset clips and "T" bar grid defining the finished level of the ceiling panels.

Figure 10:
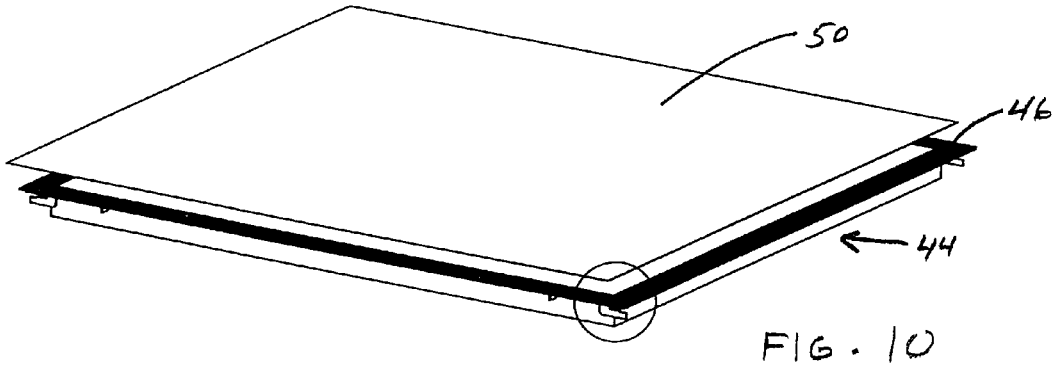
FIG. 10 is an exploded perspective view showing the assembly of a ceiling panel.
Figure 12:
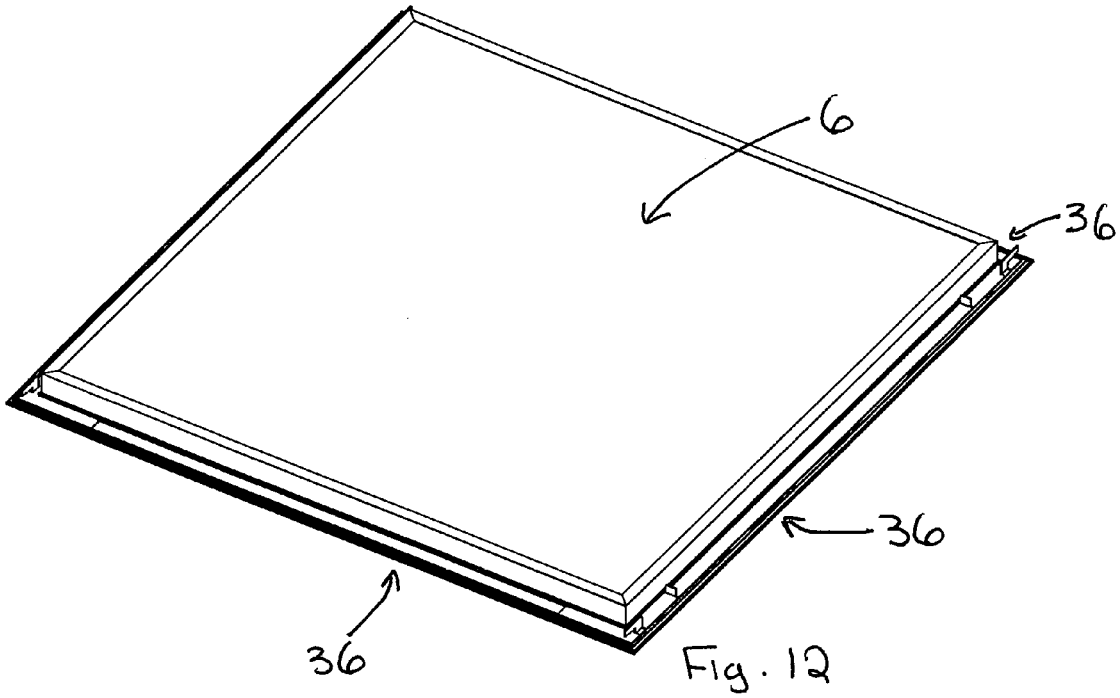
FIG. 12 is a rear perspective view of a finished ceiling panel.
Figure 13:
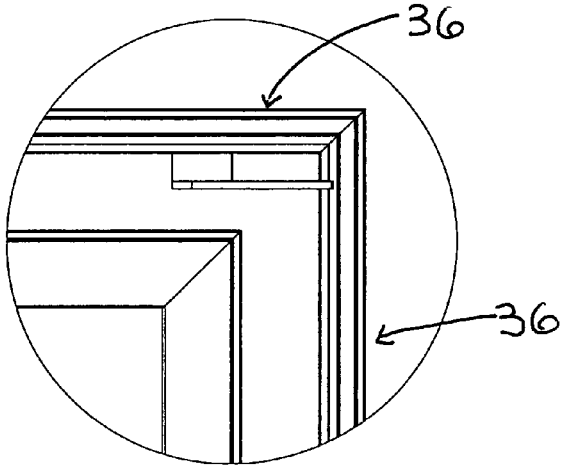
FIG. 13 is a top view showing details of the suspension gusset.
Figure 14:
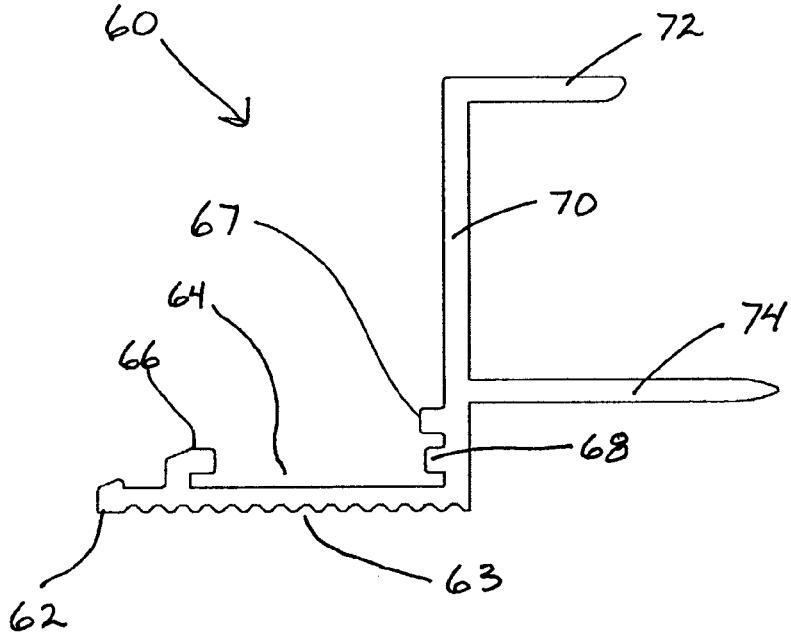
FIG. 14 is a cross section through an extruded member used to frame the ceiling panel.
Figure 15:
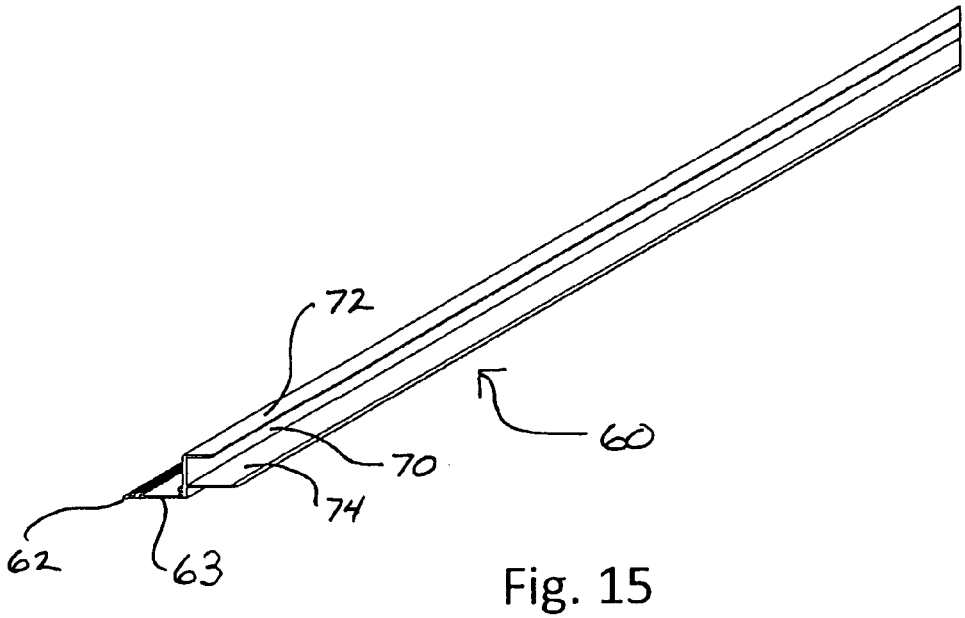
FIG. 15 is a perspective view of the extrusion used to define the outer edge of the ceiling panel.

FIGS. 14 and 15 show the extrusion member 60, preferably an aluminum extruded member, that defines the perimeter flange of the ceiling panels. This extrusion member is a miter cut to define the corners of a rectangular panel. The extrusion member includes an outwardly extending flange 62 that has a lower ribbed surface 63 used to secure a finishing substrate 50 (see FIGS. 10 and 11) of the ceiling panel. The finishing substrate 50 is adhered to the acoustical dampening material 40 of a ceiling panel as well as the ribbed surface 63. The extrusion member 60 includes the securing channel 64 on an upper surface of the outwardly extending flange 62. The securing channel 64 includes opposed side arms 66 and 68. This securing channel 64 receives first arm 26 and second arm 28 of each gusset clip 20. The securing channel 64 in one embodiment includes one or more deformable shallow ridges extending in the length of the channel to create a slight interference fit between the securing channel 64 and the first and second arms of the gusset clip. Alternatively, an adhesive can be used to secure the gusset clip arms in the securing channel 64.

FIGS. 7, 8, 12 and 13 illustrate a finished ceiling panel 6 having the perimeter flange 36 extending thereabout with gusset clips 20 engaging the abutting extrusion member at the corners of the panels. Referring to FIG. 1, each gusset clip 20 is generally L-shaped and defined by a first arm 26 and a second arm 28. The gusset clip 20 includes an upwardly and forwardly extending securing tab 22 with a securing gap 24 provided below this securing tab and above the perimeter frame 36 of the ceiling panel. The upwardly and forwardly extending securing tab also includes a locating notch 30 that allows nesting of the ceiling panels on the "T" bar support members in a predetermined position aligned with the grid network. The second arm of the gusset clip includes an aligning tab 32 at one end of the second arm, located outwardly of the securing tab 22, to provide accurate positioning of the panel relative to the T bar frame. Each rectangular panel has an aligning tab adjacent the panel corners to align the panels with the cross "T"'s of the grid system.

Figure 16:
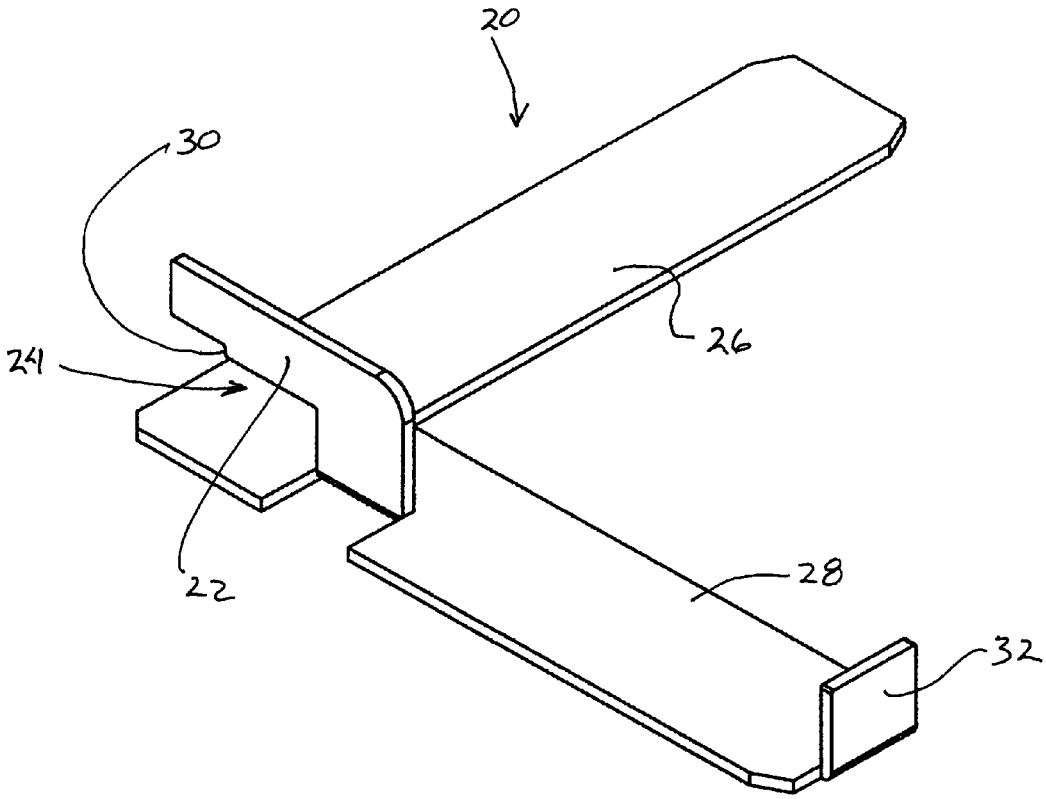
FIG. 16 is a perspective view of the suspension gusset.

As shown in the perspective view of FIG. 16, the gusset clip 20, and in particular the upwardly and forwardly extending securing tab 22, is integral with the second arm. The gusset clip is preferably punched from a metal sheet and the securing tab 22 bent upwardly. This accurately locates the locating notch 30 relative to the corner of the finished ceiling panel 6. The securing tab terminates slightly short of the perimeter flange to allow over shifting relative to a "T"-member during installation of the ceiling panel.

The extrusion member 60 includes vertical section 70 extending upwardly from the outwardly extending flange 62 and this vertical section acts as a frame about and in engagement with the acoustical material 40 of the ceiling panel. The vertical section 70 includes a top inwardly directed flange 72 that overlies the top surface of the acoustical dampening material 40 and an intermediate securing flange 74 that is inserted into the acoustical dampening material. Depending upon the particular acoustical dampening material, this intermediate securing flange is preferably received in a slot of the dampening material and has a slight interference fit therewith. Typically the securing flange includes a ribbed surface and an adhesive can also be used to improve securement.

Figure 4:
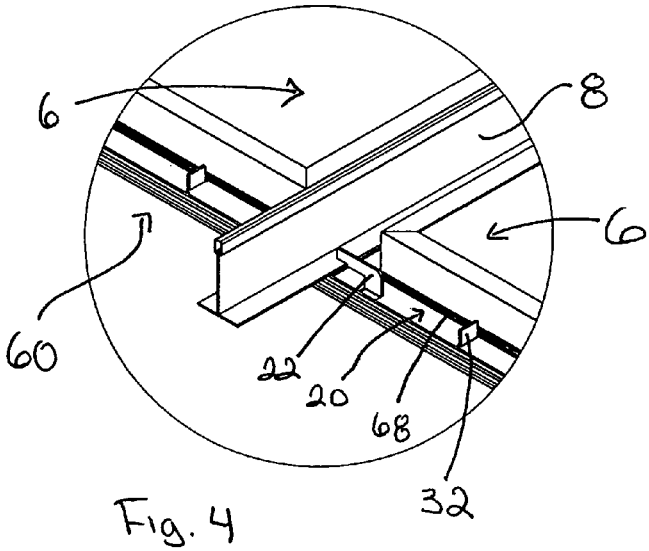
FIG. 4 is a partial perspective view showing the securement of two ceiling panels to the "T" bar grid member.

As shown in FIG. 4, this extrusion member 60 defines the perimeter edge of the ceiling panels and accurately defines the lower surface of the ceiling panel. The gusset clips are received in the extrusion members and accurately locate the upwardly and forwardly extending securing tabs 22 adjacent the corners of the panel. This particular structure of the ceiling panel allows a large portion of the acoustical dampening material to be positioned above the lower flange of the T bar, thus reducing the distance between the lower flange of the T bar and the bottom edge of the ceiling panel. The extrusion member also defines a border edge of the acoustical dampening material 40 and serves to protect this material.

FIG. 4 and FIG. 16 show details of the gusset clip and also illustrate how the position of aligning tab 32 has been bent upwardly from the second arm and engages the edge of an alignment ridge 67 provided on the extrusion member. This engagement can be used to locate the gusset clip relative to the corner of the panel. The opposite edge of the aligning tab 32 also serves as an aligning surface for positioning of the ceiling panel beneath the "T" bar grid network and acts like a spacer. The aligning edge 34 abuts the cross bars of the T bar structure acts like a spacer, controlling the alignment gaps between adjacent panels.

Figure 2:
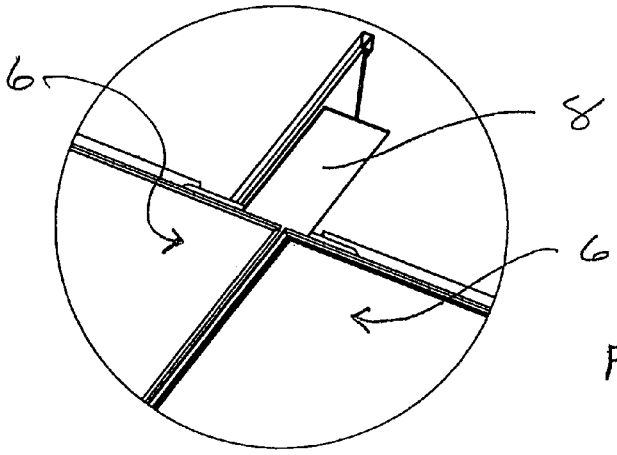
FIG. 2 is a partial perspective view of the abutment of two ceiling panels beneath a main grid member.

A further benefit of the ceiling system is shown in FIG. 2 where the perimeter flange of each ceiling panel is immediately below the grid network and preferably the main "T"-members 8. This provides accurate positioning of the ceiling panels beneath the grid members. The gusset clips 20 are accurately secured on the extrusion member as opposed to a top surface of the ceiling panel. This arrangement avoids additional tolerance variations that can occur between the top surface of the ceiling panel and the finished surface of the ceiling panel. With the present arrangement, abutting ceiling panels are accurately located beneath the "T" members and thus the junction between adjacent panels is improved and the visual appeal of the ceiling is improved (less variation).

The present system advantageously uses the "T" bar grid support network that is widely available and relatively cost effective to use. Improved accuracy of a lift and shift ceiling system is provided beneath the "T" bar grid network by using extrusion members with a wide perimeter flange about the ceiling panels. This perimeter flange is essentially immediately below the lower flange of the "T" bar support network. The securing of the ceiling panel beneath the "T" bar grid network is achieved by using stamped gusset clips preferably that are received in channels of the extrusion members. These gusset clips can only secure the extrusion members about the body of the acoustical ceiling panel, but they also accurately define the suspension points. A substantial portion of the ceiling panel is above the lower flange of the "T" bar grid network where tolerance variations in the thickness of the overall ceiling panel are not transmitted to the finished surface.

The ceiling panels also include a wide perimeter flange about the ceiling panels and this is defined by the extrusion members used to define this edge. These extrusion members include an outwardly extending flange which on the lower surface preferably includes a series of ribs. These ribs are used to assist in the adhesive securement of a finishing substrate while providing a transition between the acoustical dampening material and the edge of the ceiling panels. This blends any variations and hides the outer perimeter frame.

Figure 17:
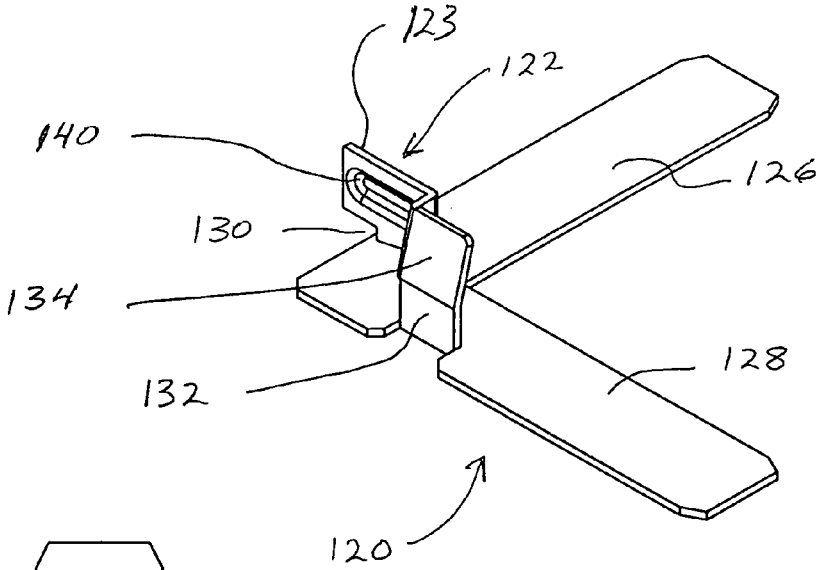
FIG. 17 is a perspective view of a modified suspension gusset clip.

The modified gusset clip 120 of FIGS. 17 through 19 again includes a first arm 126 and a second arm 128 that are received in extrusion members 60 of the ceiling panels. In particular these arms are received in the securing channel 64 on an upper surface of the extrusion member 60. In contrast to the gusset clip 20 the junction of the first arm 126 and the second arm 128 includes the securing tab 122 that is integral with the second arm 128 and the securing tab 122 also includes the panel aligning surface 132 and the panel guide surface 134 which is canted relative to surface 132. The securing tab includes the end 123 that is off set and inwardly positioned relative to the alignment surface 132. As shown in FIG. 17 as well as the top view of FIG. 18 basically the end 123 is inwardly offset relative to the alignment surface 132 which is inwardly spaced from the exterior edge of arm 128. Alignment surface 132 is positioned to engage and accurately position a panel relative to the "T" bar flange. Guide surface 134 is inwardly angled to allow initial positioning of the panel relative to the "T" bar flange and the securing tab 122 is further inwardly offset and will provide the support on the "T" bar flange.

Figure 3:
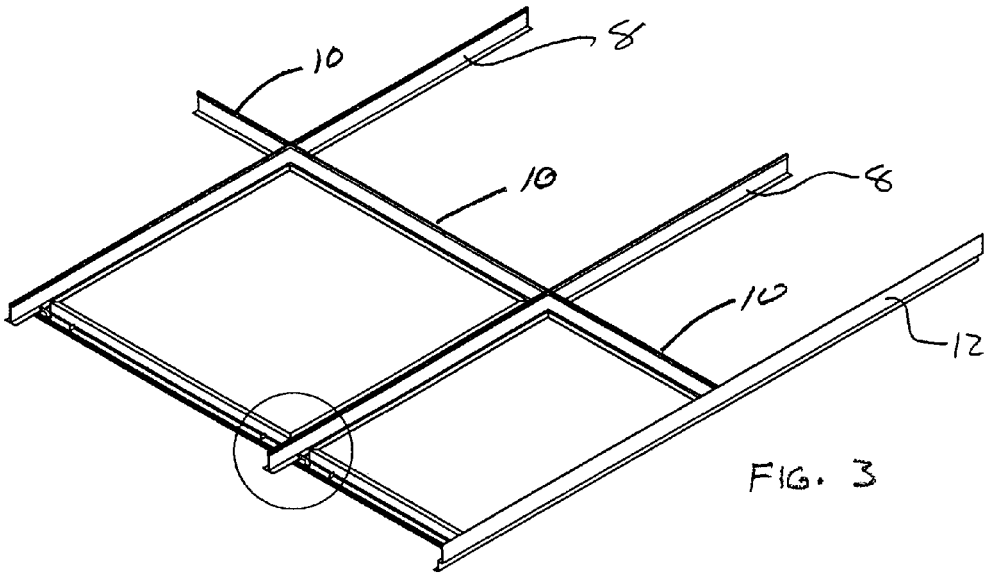
FIG. 3 is a partial perspective view of the suspended ceiling system from above the "T" bar network looking downwardly onto the ceiling panels.
Figure 5:
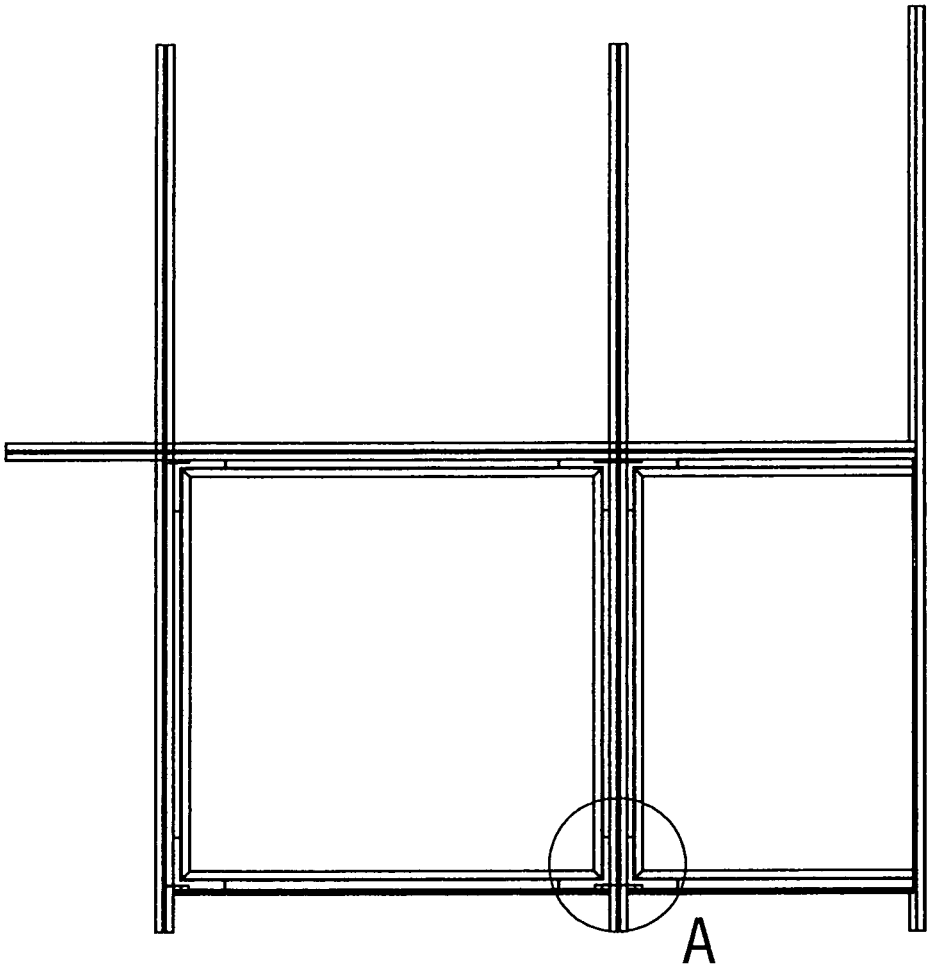
FIG. 5 is a top view looking downwardly on the securement of two ceiling panels beneath the grid network.
Figure 6:
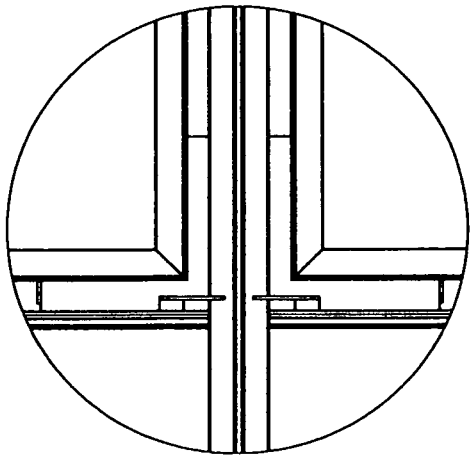
FIG. 6 is a top view showing two of the ceiling panels either side of a main grid member.
Figure 19:
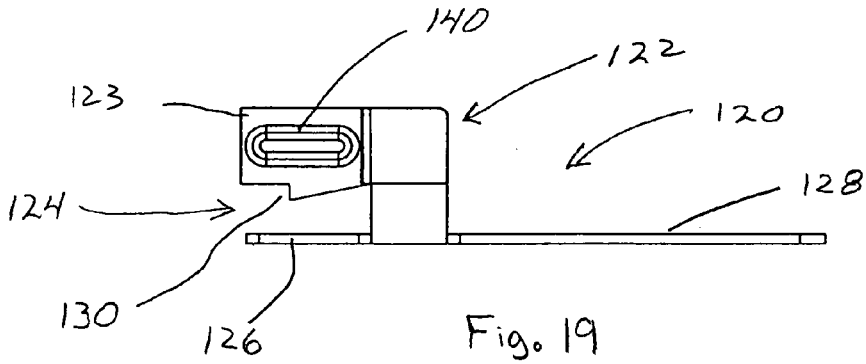
FIG. 19 is a side view of the modified gusset clip of FIG. 17.
Figure 20:
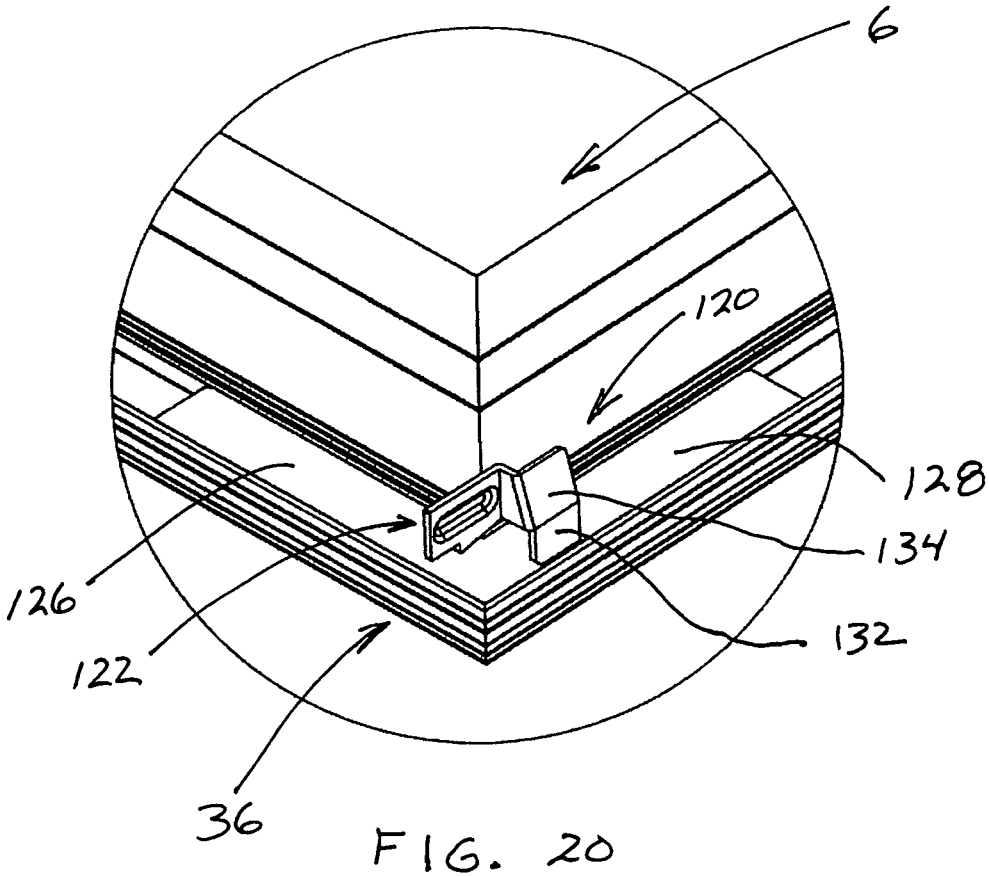
FIG. 20 is a partial perspective view of the modified gusset clip installed at a corner of a ceiling panel.

The modified gusset clip 120 also includes the locating notch 30 on the securing tab 122 and this does provide alignment and accurate positioning beneath the "T" bar grid. As shown in FIG. 19 the modified gusset clip 120 does allow for shifting of the panel to one side on the "T" bar grid and then subsequent movement back to accurately locate the panel via the locating notch 130. As shown in FIGS. 3, 4 and 5 the opposite end of a panel will also include a similar clip but with an opposite orientation. FIG. 20 illustrates a ceiling panel corner with the modified gusset clip 120.

Figure 18:
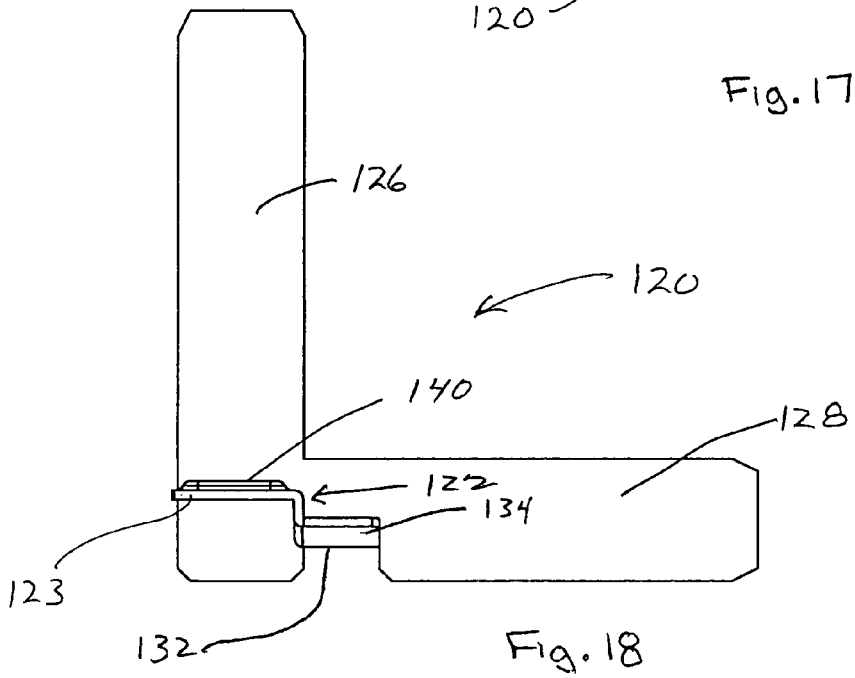
FIG. 18 is a top view of the gusset clip of FIG. 17.

The modified gusset clip 120 of FIGS. 17 through 19 has effectively combined the securing tab 22 of gusset clip 20 and the aligning tab 132 into a single tab that is bent from the second arm 128. The consolidation of these functions in a single tab makes the gusset clip more cost effective to manufacture.

A further feature of the modified gusset clip is the securing port 140. In some cases if a panel is used adjacent a wall or due to particular circumstances it may be desirable to secure the panel by means of the port 140. Typically this port is not used but there may be circumstances where it is preferable to provide support through this component.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A ceiling panel comprising a perimeter frame, an acoustical insert secured within said perimeter frame and inwardly offset from a side edge of said ceiling panel, and a finished surface substrate secured beneath and covering a lower surface of said perimeter frame and said acoustical insert material; said perimeter frame comprising a series of connected extruded members where each extruded member includes an outwardly extending flange defining a wide border edge of said ceiling panel and an integral vertical section to one side of said flange; and wherein said finished surface substrate is secured to said outwardly extending flange of each extruded member and said vertical section of each, extruded member is held in abutting contact with a side edge of said acoustical insert; and wherein each extruded member includes in cross section at least one securing flange extending inwardly from said vertical section and located at an end of said vertical section opposite said outwardly extending flange or at an intermediate position on said vertical section.

2. A ceiling panel as claimed in claim 1 wherein a top surface of each outwardly extending flange includes a low profile securing channel extending in a length thereof.

3. A ceiling panel as claimed in claim 2 including gusset securing brackets where each gusset securing bracket is received in the low profile securing channels of abutting extruded members and secures said abutting extruded members.

4. A ceiling panel as claimed in claim 3 wherein each gusset securing bracket is generally made of 'L' shaped stamped plate with at least one upwardly and forwardly extending securing tab defining a securing gap below said securing tab for supporting said ceiling panel from a 'T' bar grid.

5. A ceiling panel as claimed in claim 4 wherein each gusset securing bracket includes a first flat arm without any significant protrusions on an upper surface thereof and a second flat arm having said at least one upwardly extending securing tab with a horizontal extending segment.

6. A ceiling panel as claimed in claim 5 wherein said at least one upwardly and forwardly extending securing tab extends upwardly at an intermediate position with respect to a width of said second flat arm.

7. A ceiling panel as claimed in 6 wherein said forwardly extending securing tab includes a positioning notch.

8. A ceiling panel as claimed in 7 wherein each gusset securing bracket includes at least one upwardly extending alignment face on said arm for panel alignment with a 'T' bar grid.

9. A ceiling panel as claimed in claim 8 wherein said alignment tab is located at an intermediate position with respect to the width of said second arm.

10. A ceiling panel as claimed in claim 9 wherein said outwardly extending flange on a bottom surface includes a series of longitudinally extending shallow ribs of a progressively decreasing height from said vertical section to said perimeter of said ceiling panel.

11. A ceiling panel as claimed in claim 8 wherein said alignment face is part of said securing tab and is connected to said second arm; said alignment face including an inwardly inclined guide face connecting said alignment face to an outwardly projecting securing flange.

12. A ceiling panel as claimed in claim 11 wherein said securing flange includes a securing port passing therethrough.

13. A ceiling panel as claimed in claim 7 wherein said series of shallow ribs includes at least three shallow ribs.

14. A ceiling panel as claimed in claim 3 wherein said ceiling panel is rectangular with four corners with gusset securing brackets in each corner and wherein said gusset securing brackets include a first pair of adjacent gusset securing brackets on two of said corners with said horizontal extending segment orientated in a first direction and a second pair of adjacent gusset securing brackets on the two remaining corners with said horizontal extending segments orientated in a second direction opposite to said first direction.

15. A ceiling panel as claimed in claim 14 wherein said panel is suspended below a 'T' bar ceiling grid network by said gusset securing brackets engaging bottom flanges of said ceiling grid network.

16. A ceiling panel comprising a perimeter frame, an acoustical insert secured within said perimeter frame and inwardly offset from a side edge of said ceiling panel, and a finished surface substrate secured beneath and covering a lower surface of said perimeter frame and said acoustical insert material; said perimeter frame comprising a series of connected extruded members where each extruded member includes an outwardly extending flange defining a wide border edge of said ceiling panel and an integral vertical section to one side of said flange; and wherein said finished surface substrate is secured to said outwardly extending flange of each extruded member and said vertical section of each extruded member is held in abutting contact with a side edge of said acoustical insert; and wherein each extruded member includes two inwardly extending securing flanges positioned in a non-aligned manner with said outwardly extending flange.

17. A ceiling panel as claimed in claim 16 wherein one of said inwardly extending flanges overlies a top edge of said acoustical insert.

18. A ceiling panel as claimed in claim 17 wherein one of said inwardly extending flanges is received and projects into a side edge of said acoustical insert.

* * * * *